US005425205A

United States Patent [19]

Ha

[11] Patent Number: 5,425,205

[45] Date of Patent: Jun. 20, 1995

[54] DOOR HOLDING APPARATUS OF REFRIGERATOR

[75] Inventor: Jae-Kook Ha, Kwangmyung, Rep. of Korea

[73] Assignee: Samsung Electronics Co., Ltd., Suwon, Rep. of Korea

[21] Appl. No.: 167,057

[22] Filed: Dec. 16, 1993

[30] Foreign Application Priority Data

Dec. 17, 1992 [KR] Rep. of Korea ..... U.M.92-25743

[51] Int. Cl.[6] ..... E05C 7/04

[52] U.S. Cl. ..... 49/366; 49/306; 49/313; 49/394

[58] Field of Search ..... 49/366, 368, 394, 303, 49/306, 313, 314; 312/405, 296

[56] References Cited

U.S. PATENT DOCUMENTS

| | | | |
|---|---|---|---|
| 1,918,911 | 7/1933 | Hull | 49/313 |
| 2,692,809 | 10/1954 | Kesling | 49/368 X |
| 3,077,644 | 2/1963 | Kesling | 49/366 |
| 3,362,108 | 1/1968 | Jones | 49/366 X |
| 3,660,940 | 5/1972 | Tavano | 49/366 |

FOREIGN PATENT DOCUMENTS

| | | |
|---|---|---|
| 4/136679 | 5/1992 | Japan . |
| 4/288470 | 10/1992 | Japan . |

*Primary Examiner*—Philip C. Kannan

*Attorney, Agent, or Firm*—Burns, Doane, Swecker & Mathis

[57] ABSTRACT

A refrigerator includes a body forming a refrigeration compartment (for cooling or freezing). The compartment has an access opening closed by a pair of side-by-side doors that are hinged adjacent opposite vertical edges of the opening. Each door includes a frame and a slide mounted in a free edge of the slide for horizontal sliding movement. When the doors are being closed, the slides engage displacement surfaces on the body which pull the slides partially out of the frame so that resilient packing members carried by the slides are moved into contact with one another to create an air seal along a vertical interface between the two doors. A magnet on the body attracts metal plates carried by the slides to hold the doors closed. Keeper members can be mounted on the body for yieldably engaging grooves formed in the slides for aiding in holding the doors closed.

21 Claims, 11 Drawing Sheets

DOOR HOLDING APPARATUS OF REFRIGERATOR

BACKGROUND OF THE INVENTION

1. Field of the Invention

The present invention relates to a door holding apparatus for a refrigerator.

2. Description of the Prior Art

As prior art of this type of door holding apparatus for a refrigerator, a Japanese laid open patent application No. Heisei 4-288470 and another Japanese laid open patent application No. Heisei 4-136679 were disclosed.

Particularly, in the Japanese laid open patent application No. Heisei 4-288470 disclosing the door apparatus of a refrigerator as illustrated herein in detail in FIGS. 8, 9 and 10, an adiabatic (refrigeration) cabinet 11 comprises an outerwall 12 of steel plate and an innerwall 13 of plastic material with insulation material stuffed therebetween.

At the upper portion of the adiabatic cabinet 11, there is formed a refrigerating chamber 15, and first and second opening/shutting type doors 16 and 17 are rotatably disposed by respective hinges 18 at left and right sides of an opening 15*a* of the refrigerating chamber 15.

Magnetic gaskets 19 are respectively disposed on fringe areas of an inner periphery of each of the first and second doors 16 and 17.

Support members 20 and 21 are respectively attached to upper and lower areas around inner tip areas of the free i.e., unhinged, side of the first door 16 by respective guide pins 22 as illustrated in FIG. 11, and a compartment member 23 is rotatably supported by the support members 20 and 21 by means of a pin 24 as illustrated in FIGS. 9 and 10.

The compartment member 23 takes a shape of a pillar extending from an upper end to a lower end of the opening 15*a*, and a guide groove 25 of circular arc shape with one end opened is formed on both upper and lower ends of the compartment member 23, as illustrated in FIGS. 9 and 10.

Meanwhile, a position determination unit , or stop projection, 27 is protrudingly and integrally formed on the lower support member 21 as illustrated in FIG. 10, and under a state where the first door 16 is closed, the position determination unit 27 contacts a side 23*a* of the compartment member 23, thereby maintaining a front 23*b* of the compartment member 23 to be approximately on a line with a front line of the opening 15*a*.

The support member 21 is disposed with a torsion coil spring 28 at the lower area thereof, and the torsion coil spring 28 the compartment member 23 to a position shown in broken lines in FIG. 9.

In a conventional refrigerator thus constructed with a pair of doors, lower and upper guide pins 29 attached to the cabinet II invade into a the lower and upper guide grooves 25 under a state where the first and second doors 16 and 17 are closed, as illustrated in FIG. 9, causing the compartment member 23 to be pivoted to one side.

Under these circumstances, the respective magnetic gaskets of the first and second doors 16 and 17 are drawn into an inner periphery of the opening 15*a* and the front 23*b* of the compartment member 23.

Under the above state, when the first door 16 on the left is rotatably moved in an arrow direction A in order to open the first door 16, as illustrated in FIGS. 9 and 10, the compartment member 23 is rotatably moved in the arrow direction B around a guide pin 22, thereby resulting in the guide pin 29 sliding relatively along the guide groove 25.

According to the rotative movement of the compartment member 23 in toward the arrow direction B, respective magnetic gaskets 19 are separated from the front 23*b* of the compartment member 23.

When the first door 16 is rotatably moved toward a dotted line as illustrated in FIG. 9, a state happens where the guide pin 29 is pulled out of the guide groove 25, and at the same time, a state arises where the compartment member 23 is rotatably moved 90 degrees in a direction opposite that in which the first door is opened.

When the opened first door 16 is to be closed, the first door 16 is rotatably moved oppositely from the arrow direction A, thereby resulting in an open end of the guide groove 25 to be forced against the guide pin 29 which thereafter slides along the guide groove 25.

Accordingly, the compartment member 23 is rotatably moved in an opposite direction from the arrow indication B to thereby be in an operational state so that the compartment member comes to be closed as illustrated in FIG. 9 in a continuous line.

Meanwhile, when the second door 17 is to be opened or closed while the first door 16 is closed, the compartment member 23 maintains the operational state, and the magnetic gasket 19 of the second door 17 is separated from the front 23*b* of the compartment member 23.

The conventional door apparatus thus described is supposed to be constructed in such way that the front 23*b* of the compartment member 23 maintains a parallel line with a front 15*b* of the opening 15*a* while the first door 16 is closed in order to keep the refrigerating chamber from being invaded by outside air. However the front 23*b* of the compartment member 23 might not coinside with the front line of the opening 15*a* due to inaccuracy of dimensions of each component, a variance of attached positions and the like, whereby the member could protrude forward to be pushed inwardly into an interior of the chamber, causing a case where the same is attached in a slanted position, consequently, the inside of the refrigerator would not be kept from being exposed to the outside air. Also, refrigerating efficiency deteriorates and power consumption is increased.

OBJECT AND SUMMARY OF THE INVENTION

Accordingly, the present invention is disclosed to solve the aforementioned problems and it is an object of the present invention to provide a door holding apparatus of a refrigerator for improving an airtightness of the door against the outside air.

It is another object of the present invention to provide a door holding apparatus of a refrigerator for improving a refrigerating efficiency to thereby decrease the power consumption of the refrigerator.

In order to attain the aforesaid goals, according to the present invention, there is provided a door holding apparatus of a refrigerator wherein a pair of doors are disposed by hinges at a front of a refrigerator body for opening and closing of the doors, the apparatus comprising:

slide members inserted by elastic members at tips of the pair of doors for elastic performance according to the opening and closing of the door; and a pair of concaved groove members disposed on at least one side of an upper or a lower area of a center of the refrigerator body in order to have an integrally formed protrusion inserted into an inside of the slide members during door closure.

Furthermore, there is provided a door holding apparatus for a refrigerator wherein a pair of doors are disposed by hinges at the front of the refrigerator body for opening and closing of the same, the apparatus comprising:

slide members inserted by elastic members at tips of the pair of doors for elastic performance according to the opening and closing of the door;

a pair of groove members disposed on at least one side of an upper or a lower area of a center of the refrigerator body in order to have an integrally formed protrusion inserted into an inside of the slide members during door closure; and a holding means for tightly keeping closure of the door by being engaged with a keeper groove formed on a vertical surface of the slide members.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF PREFERRED EMBODIMENT OF THE INVENTION

The first embodiment of the present invention will be described in detail with reference to the accompanying drawings.

Figure 1:
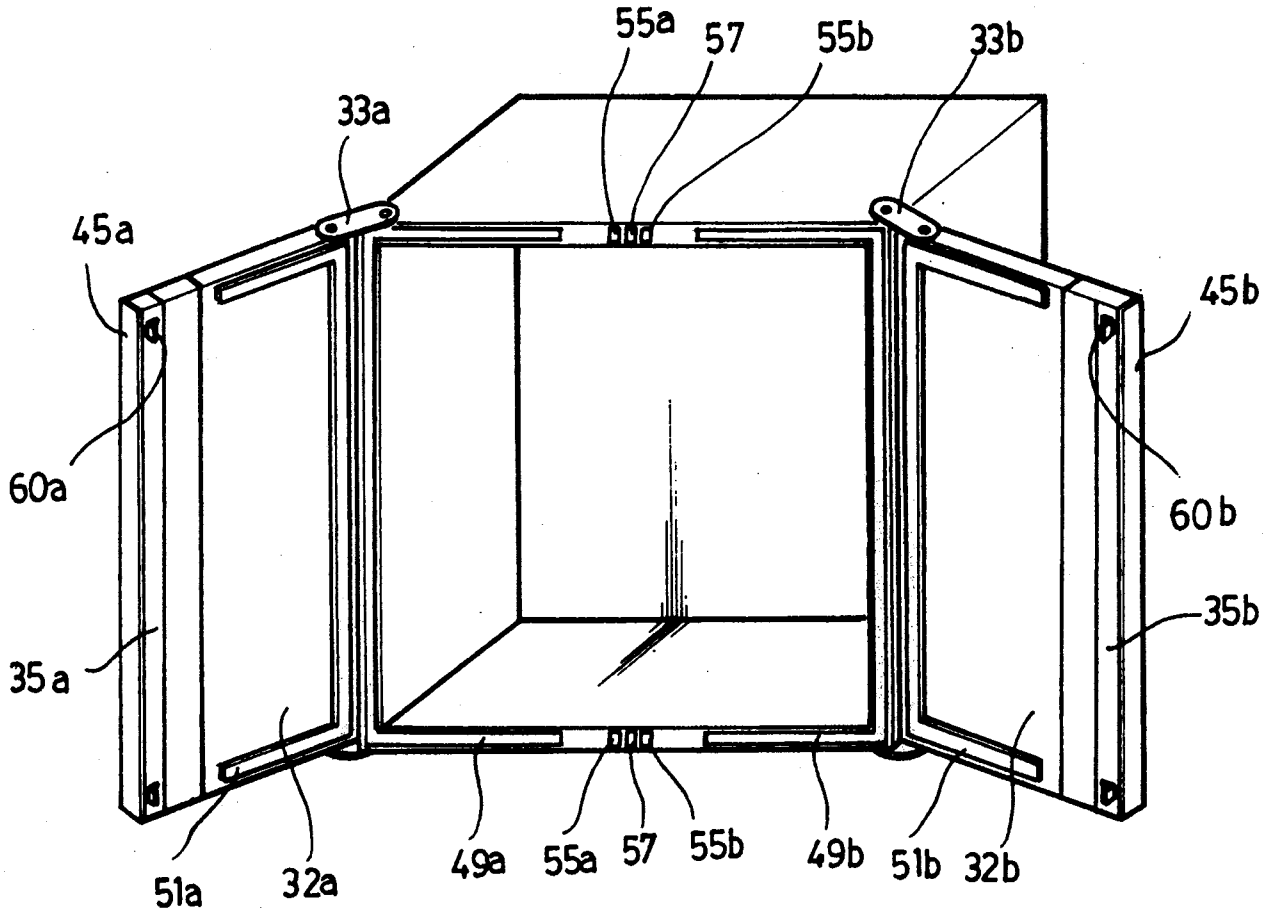
FIG. 1 is an overall perspective view for illustrating a pair of doors for a refrigerator according to a first embodiment of the present invention.
Figure 2:
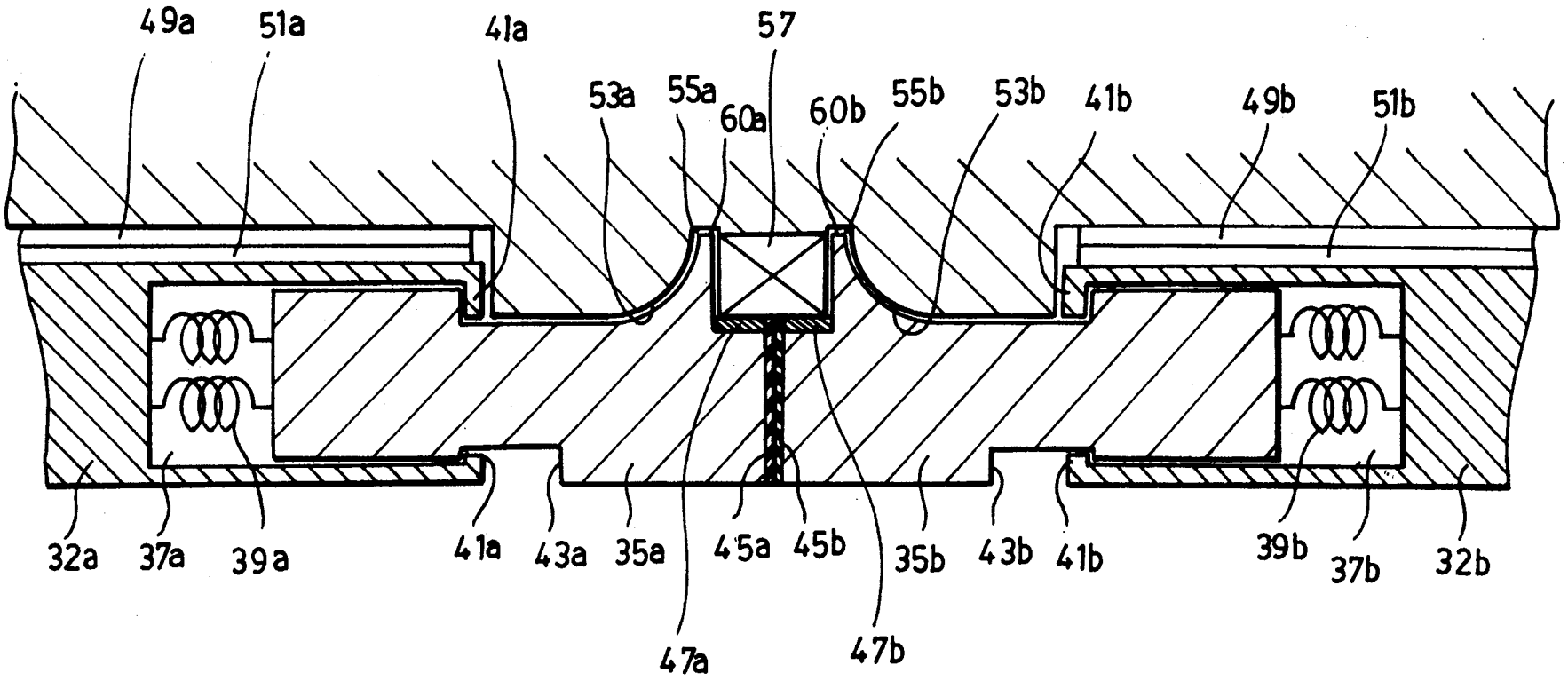
FIG. 2 is a horizontal sectional view of major parts for illustrating a state where the door for the refrigerator is closed according to the first embodiment of the present invention.
Figure 3:
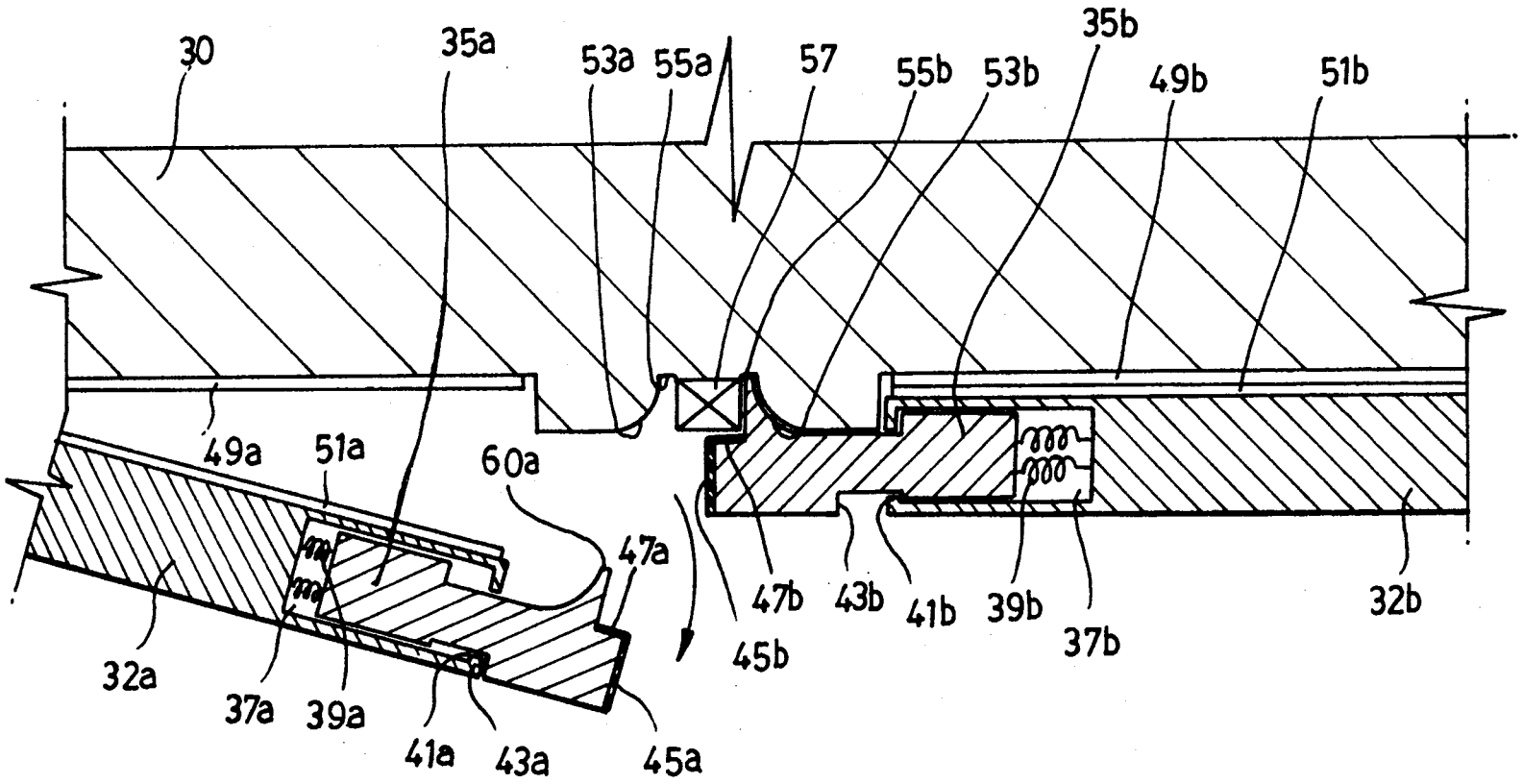
FIG. 3 is a view similar to FIG. 2 wherein one of the doors is open

As illustrated in detail in FIGS. 1, 2 and 3, a left and a right door 32*a* and 32*b* are joined at both front sides of a refrigerator body 30 by hinges 33*a* and 33*b* for enabling the left and right doors 32*a* and 32*b* to be opened and closed. Each of the doors 32*a* and 32*b* includes a frame, one vertical edge of which is hinged to the body and another (free) vertical edge of which forms a chamber 37*a* or 37*b* in which a slide 35*a* or 35*b* is horizontally slidably disposed for inward sliding movement toward the frame or outward sliding movement away from the frame.

As illustrated in detail in FIGS. 2 and 3, the slide members 35*a* and 35*b* are provided with protrusions 60*a* and 6O*b*, and vertical grooves 43 and 43*b* are formed in vertical outer and inner sides of each slide member so that the sliding distance thereof can be regulated by stop flanges 41*a* and 41*b* formed on the doors 32*a* and 32*b*.

The tips or free edges of the slide members 35*a* and 35*b* carry packing members 45*a* and 45*b* made of natural rubber, artificial rubber, silicon rubber or the like in order to keep an inside of the refrigerator airtight from the outside air during a closed state of the doors 32*a* and 32*b*, and metal plates 47*a* and 47*b* are attached to surface of the slide members which extend perpendicularly to the packing members in order to connect the doors 32*a* and 32*b* to the body 30 by being joined with a permanent magnet (described later).

Protrusions 60*a* and 60*b* to be inserted to a groove member (described later) formed on the body 30 are integrally disposed on inner sides of the slide members 35*a* and 35*b*.

One end of each of the slide members 35*a* and 35*b* thus constructed is inserted into a chamber 37*a* and 37*b* formed in the doors 32*a* and 32*b* and the slide members 35*a* and 35*b* are flexibly disposed by torsion springs 39*a* and 39*b* made of elastic materials which pull the slide members into the chambers.

Meanwhile, magnetic gaskets 49*a*, 49*b*, 51*a* and 51*b* are respectively attached to proximities of inner peripheries of the doors 32*a* and 32*b* and to the front of the body 30 in order to keep the chamber airtight during a closed state of the doors 32*a* and 32*b*.

Guide surfaces 53*a* and 53*b* of circular arc shape are respectively formed on upper and lower sides of the body 30 near the center thereof in order that the same can correspondingly touch surfaces of circular arc shape formed on inner sides of the slide members 35*a* and 35*b* guide surfaces 53*a* and 53*b*, extended into respective grooves 55*a* and 55*b* formed in the body 30. The grooves 55*a*, 55*b* are configured to receive the protrusions 60*a* and 60*b* formed integrally on the inner surface of the slide members 35*a* and 35*b*.

On upper and lower flat surfaces located between the grooves 55*a* and 55*b*, there are attached permanent magnets 57 in order that the metal plates 47*a* and 47*b* respectively adhered on the slide members 35*a* and 35*b* of the doors 32*a* and 32*b* can be drawn by the magnetic force to thereby keep the doors 32*a* and 32*b* closed.

The magnetic force of the permanent magnet 57 is established to be stronger than the contraction force of the torsion spring 39*a* and 39*b* in order to maintain airtightness during the closed state of the doors 32*a* and 32*b*.

Next, the operation and effect of the door holding apparatus of a refrigerator thus constructed according to the first embodiment of the present invention will be described.

First of all, as illustrated in FIG. 3, when the opened doors 32*a* and 32*b* are pushed toward the body 30 in order to close the doors 32*a* and 32*b*, the protrusion 60*a*(or 60*b*) integrally formed on the inner surface of the slide member 35*a*(or 35*b*) travels along the guide surface 53*a*(or 53*b*) into the groove 55*a*(or 55*b*) to overcome the contraction force of the torsion spring 39*a*(or 39*b*).

When the protrusion 60*a*(or 60*b*) is pushed into the groove 55*a*(or 55*b*), the metal plate 47*a*(or 47*b*) attached to the inner end of the doors 32*a* and 32*b* is attracted by the magnetic force of the permanent magnet 57 to thereby maintain the doors 32*a* and 32*b* closed.

At this time, the packing members 45*a* and 45*b* respectively attached to the tips of the doors 32*a* and 32*b* are tightly engaged to each other, and at the same time, the magnetic gaskets 49*a* and 49*b* attached to the front of the body 30 and the magnetic gaskets 51*a* and 51*b* attached to the inner peripheries of the doors 32*a* and 32*b* become locked tightly to each other to thereby maintain airtightness within the refrigerating chamber.

Meanwhile, in order to open the closed door 32*a*(or 32*b*), a handle (not shown) attached to an external surface of the door 32*a*(or 32*b*) is pulled thereby pulling the metal plate 47*a*(or 47*b*) attached to the inner surface of the slide member 35*a*(or 35*b*) off the permanent magnet 57, and at the same time, pulling the protrusion 60*a*(or 60*b*) protrudingly formed on the inner surface of the slide member 35*a*(or 35*b*) from the groove 55*a*(or 55*b*) formed on the body 30 by way of the contraction force of the torsion spring 39*a*(or 39*b*), so that the door 32*a*(or 32*b*) is opened and each slide member slides along the guide surface 53*a*(53*b*).

Although the description has been made on the opening and closing of the left door 32*a* as an example, the same is applied to the right door 32*b* of the refrigerator, so overlapping explanations will be deleted.

Even in the case of opening and closing of the left and right doors being performed at the same time, the operational sequences are the same as the aforesaid to thereby delete the overlapped explanation.

Hereinafter, a door holding apparatus of a refrigerator according to the second embodiment of the present invention will be described in detail with reference to the accompanying drawings.

Likewise, in the second embodiment, if there are any portions identical to the first embodiment, identical reference numerals will be given.

Figure 4:
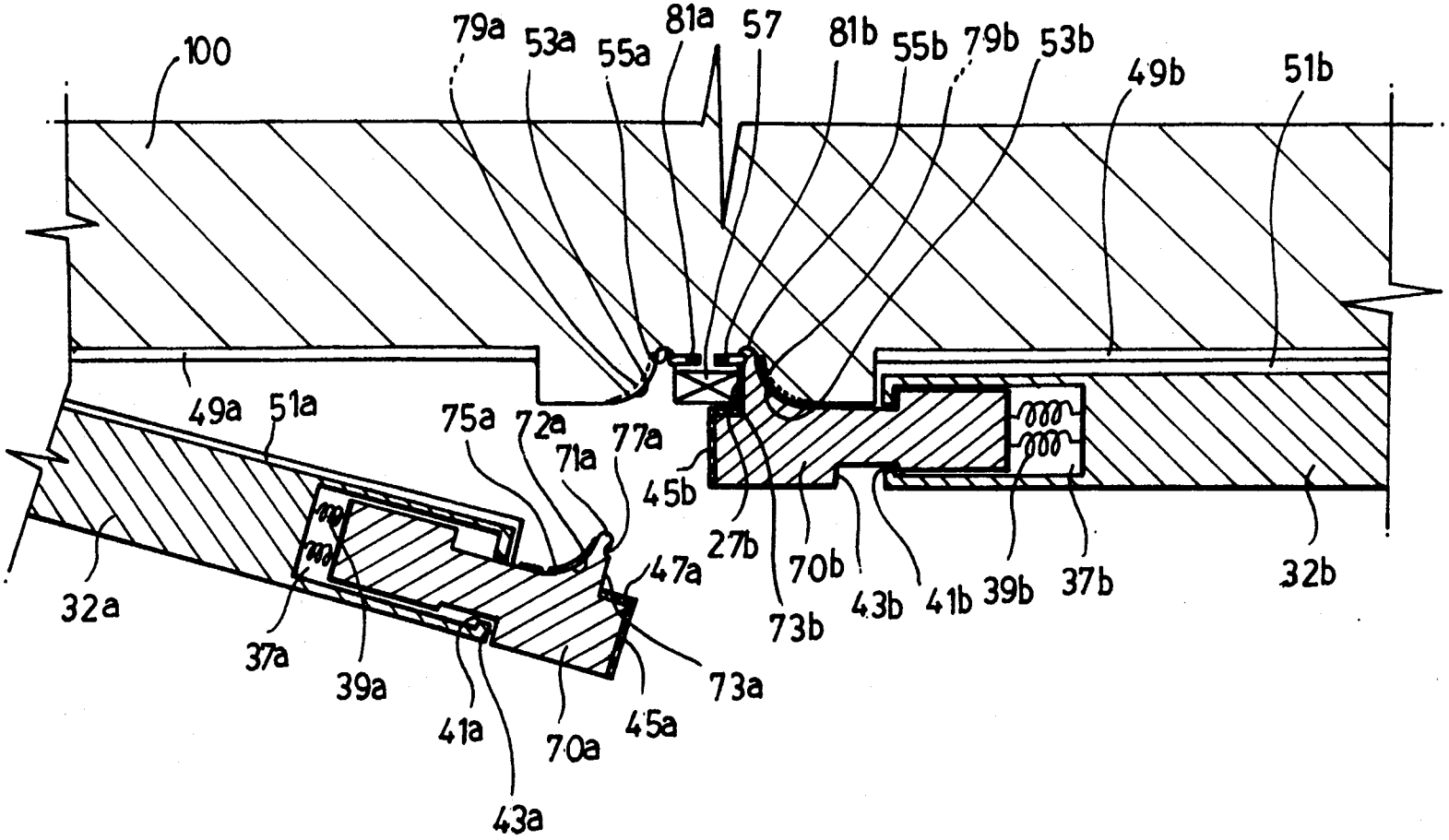
FIG. 4 is a view similar to FIG. 3 of a second embodiment of the present invention.
Figure 5:
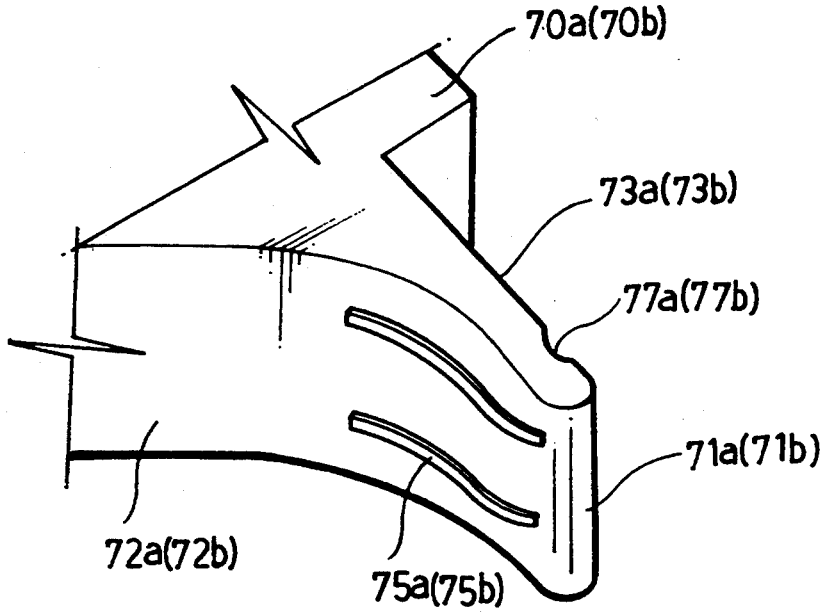
FIG. 5 is an enlarged perspective view for illustrating an enlarged protrusion shown in FIG. 4.

The difference between the construction described in the second embodiment of the present invention regarding the door holding apparatus of a refrigerator illustrated in FIGS. 4, 5, 6 and 7 and that in the first embodiment illustrated in FIGS. 1, 2 and 3 is that protrusions 71*a* and 71*b* are formed on inner surfaces of slide members 70*a* and 70*b*, and as illustrated in FIG. 5, external surfaces 73*a*, 73*b* of the protrusions 71*a* and 71*b* are flat while inner surfaces 72*a*, 72*b* are curved with circular arc shapes and at the same time, guide rails 75*a* and 75*b* having predetermined lengths are protrudingly formed on the curved surfaces 72*a* and 72*b* of the protrusions 71*a* and 71*b*, and keeper grooves 77*a* and 77*b* are formed on the flat surfaces of the protrusions 51*a* and 51*b*.

Furthermore, the difference between a body 100 construction in the second embodiment and the body 30 construction in the first embodiment of the present invention, as illustrated in FIGS; 5 and 6, is that guide grooves 79*a* and 79*b* are respectively formed on guide surfaces 53*a* and 53*b* in order to accommodate and guide the guide rails 75*a* and 75*b* respectively formed on the slide members 70 and 70*b*. Behind the permanent magnet 57 disposed on the body 100, a pair of holding means 81*a* and 81*b* are respectively disposed in order to maintain airtightness by being respectively engaged with the keeper grooves 77*a* and 77*b* respectively formed on the vertical surfaces 73*a* and 73*b* of the slide members 70*a* and 70*b* when the doors 32*a* and 32*b* are closed.

Figure 6:
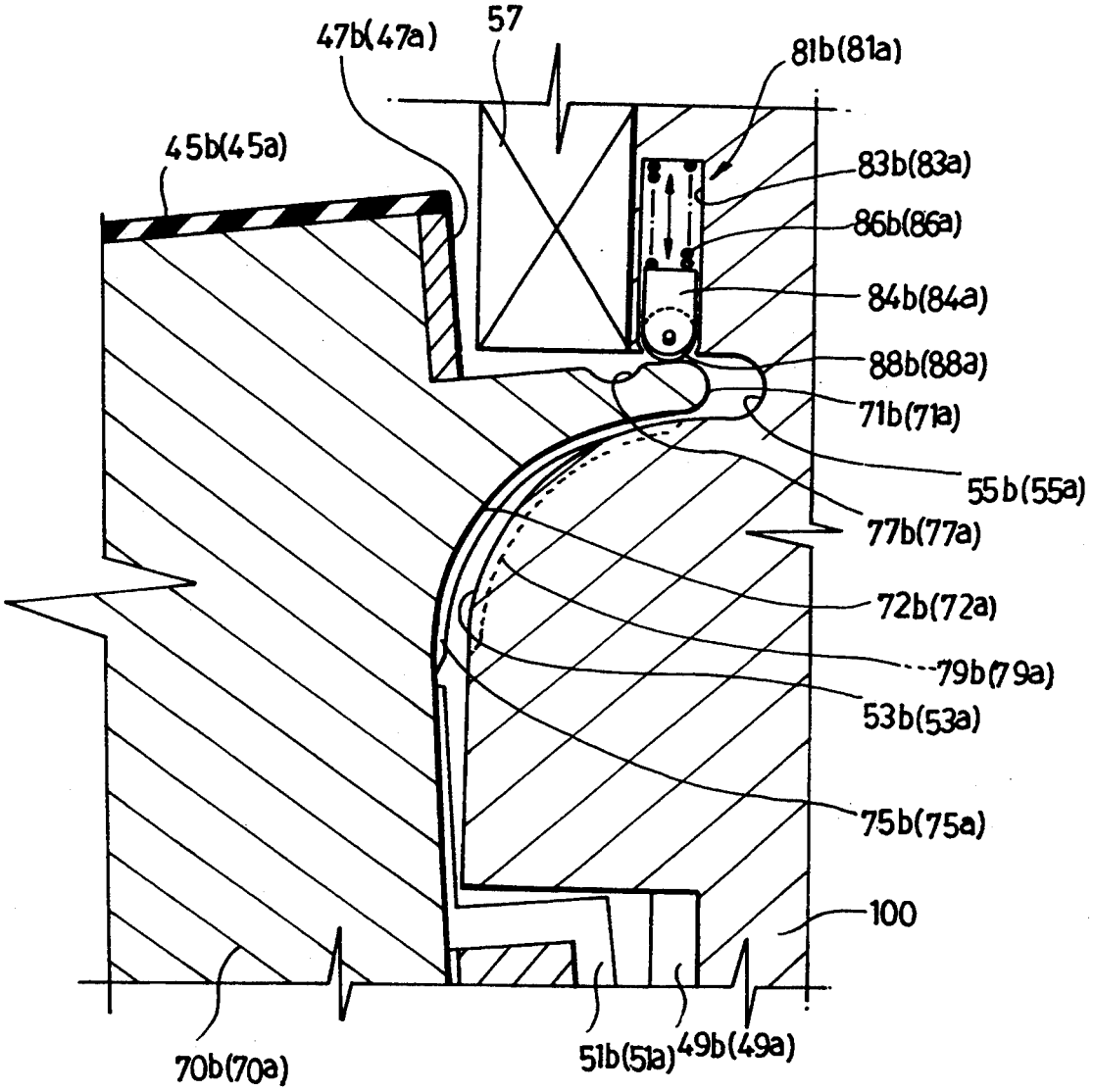
FIG. 6 is a horizontal sectional view through a partially closed door according to the second embodiment of the present invention.
Figure 7:
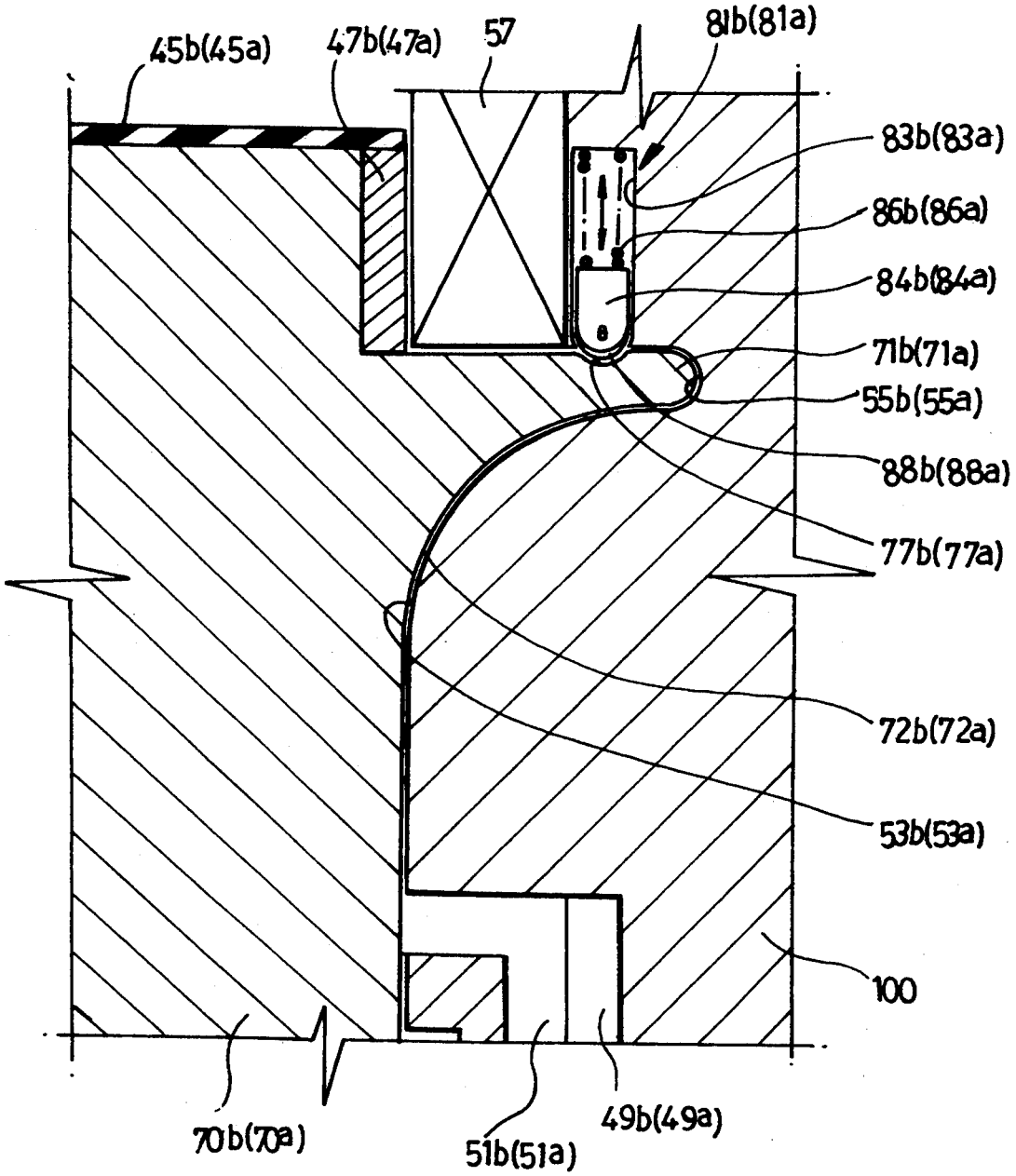
FIG. 7 is a view similar to FIG. 6 showing the door fully closed.
Figure 8:
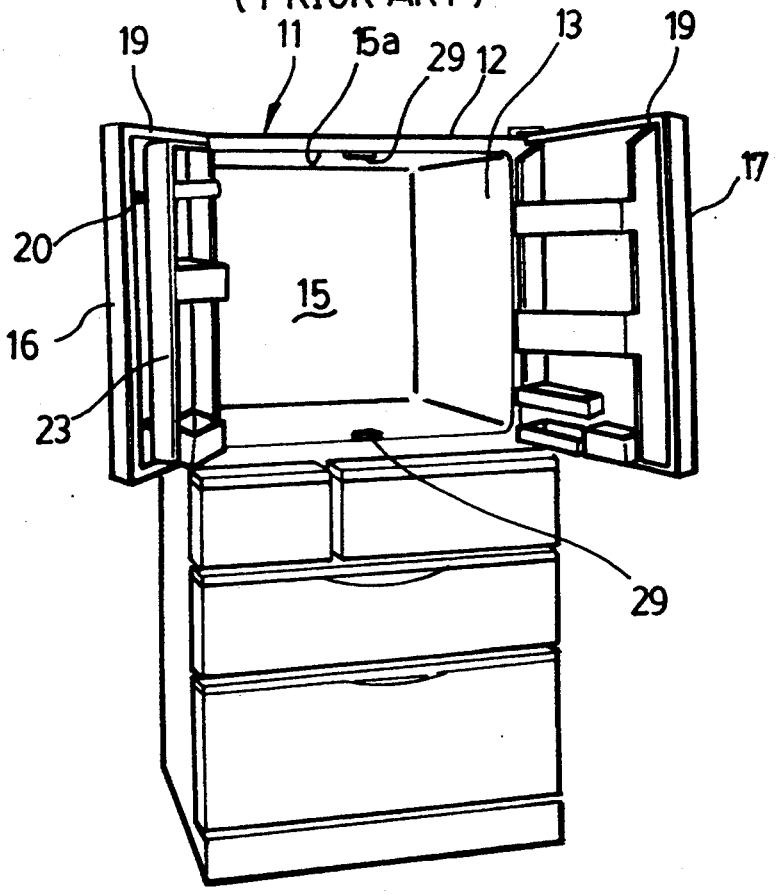
FIG.8 ( PRIOR ART )
FIG. 8 is an overall perspective view of a conventional refrigerator.
Figure 9:
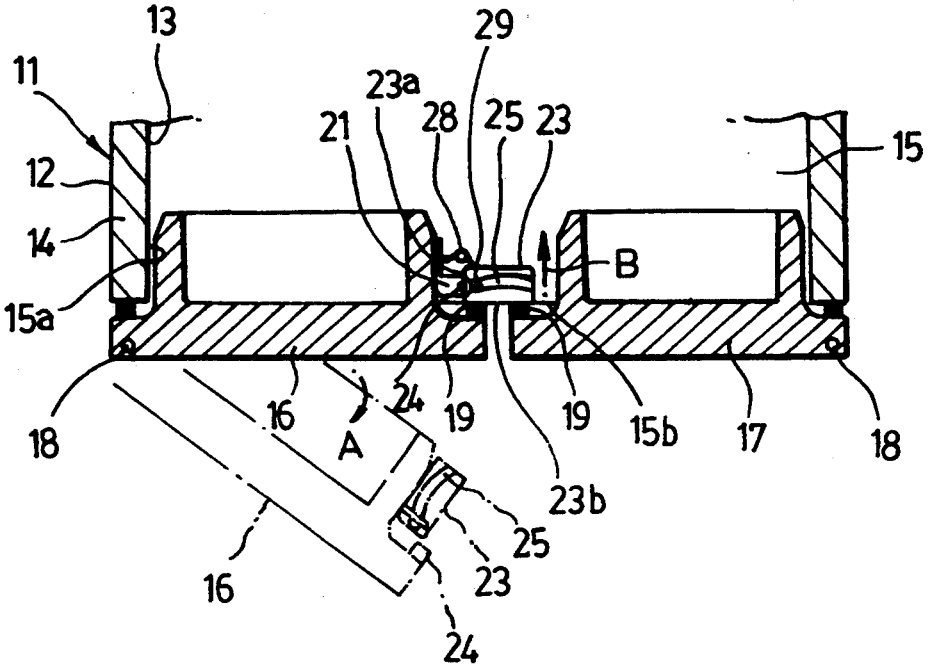
FIG. 9 ( PRIOR ART )
FIG. 9 is a horizontal sectional view through the refrigerator of FIG. 8.
Figure 10:
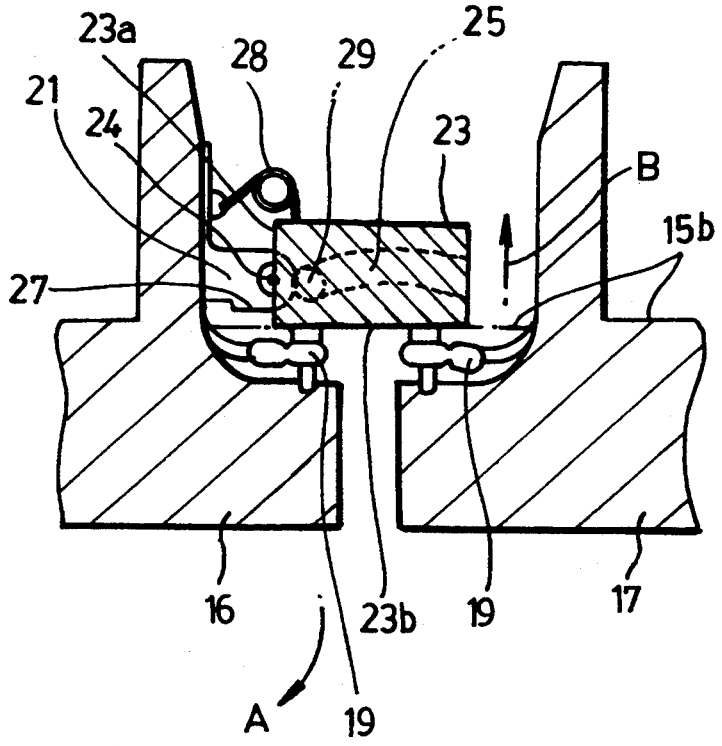
FIG. 10 (PRIOR ART)
FIG. 10 is an enlarged fragmentary view of FIG. 9.
Figure 11:
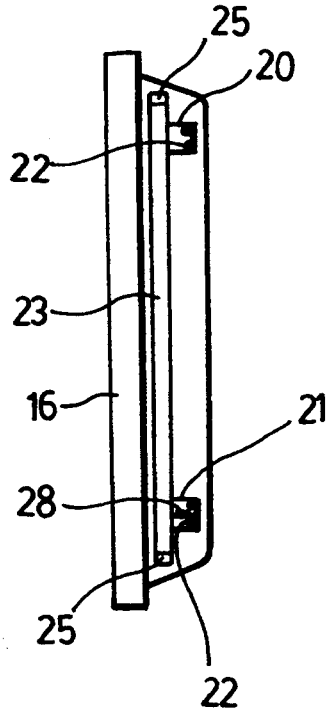
FIG. 11 (PRIOR ART)
FIG. 11 is a side view of a first door of the refrigerator of FIG. 8 wherein a compartment member is swung to an operational position.

The holding means 81*a* and 81*b*, as illustrated in FIGS. 6 and 7, comprises a clamp means 84*b*(or 84*a*) disposed in an accomodation groove 83*b*(or 83*a*) formed on the body 100 to mate with the keeper groove 77*b*(or 77*a*) formed on the vertical surface 73*b*(73*a*) of the slide member 70*b*(or 70*a*) during the closed state of the door 32*b*(or 32*a*) and to hold the door closed and thereby and in maintaining airtightness an elastic means 86*b*(or 86*a*) is provided for elastically biasing the clamp means 84*b*(or 84*a*) to thereby enable the same to travel back and forth.

The clamp means 84*b*(or 84*a*) comprises a housing; and a roller 88*b*(or 88*a*) rotatably disposed on a tip end of the housing.

Here, the roller 88*b*(or 88*a*) is so installed that the same cannot be separated from the accommodation groove 83*b*(or 83*b*) by a control means (not shown).

Next, operation and effect of the door holding apparatus of a refrigerator thus constructed according to the second embodiment of the present invention will be described.

First of all, as illustrated in FIG. 4, when the open doors 32*a* and 32*b* are pushed toward the body 100 in order to close the doors 32*a* and 32*b*, the curved surface 72*a*(or 72*b*) of the slide member 70*a*(or 70*b*) becomes contacted with the guide surface 53*a*(53*b*) of the body 100 to overcome the contraction force of the torsion spring 39*a*(or 39*b*), and at the same time, the guide rail 75*a*(or 75*b*) protrudingly formed lengthwise along the curved surface 72*a*(or 72*b*) of the slide member 70*a*(or 70*b*) is drawn and guided into the guide groove 79*a*(or 79*b*) formed on the guide surface 53*a*(53*b*) of the body 100, so that the protrusions integrally formed on the inner side of the slide member 70*a*(or 70*b*) can travel into the concaved groove 55*a*(or 55*b*) respectively formed on frontal lower and upper areas of the body 100.

At this time, one side of the protrusion 71*a*(or 71*b*) integrally formed on the slide member 70*a*(or 70*b*), as illustrated in FIG. 6, comes in touch with a roller 88*a*(or 88*b*) of the holding means 81*a*(or 81*b*) disposed on the body 100 to thereby push and move the roller 88*a*(or 88*b*) against the elastic means 86*a*(or 86*b*) to overcome the reaction force of the elastic means 86*a*(or 86*b*), so that the protrusions 71*a*(71*b*) contact the groove 55*a*(or 55*b*), thereby causing the roller 88*a*(or 88*b*) of the holding means 81*a*(or 81*b*) to engage with the keeper groove 77*a*(77*b*) formed on one side of the protrusion 71*a*(or 71*b*) and resulting in the door 32*a*(or 32*b*) being held closed at the front of the body 100.

Next, when the protrusion 71*a*(or 71*b*) is drawn into the groove 55*a*(or 55*b*), a metal plate 47*a*(or 47*b*) attached to the inner side end of the doors 32*a* and 32*b* gets attracted by magnetic force of the permanent magnet 57 to further maintain airtightness of the door.

At this time, the packing members 45*a* and 45*b* respectively disposed on tip ends of the doors 32*a* and 32*b* engage each other, and at the same time, magnetic gaskets 49*a* and 49*b* attached to the front of the body 100 and magnetic gaskets 51*a* and 51*b* attached to inner peripheries of the doors 32*a* and 32*b* are attracted to one another to thereby keep the doors 32*a* and 32*b*, closed as illustrated in FIG. 7, and to thereby maintain the airtightness of the chambers of the refrigerator.

Meanwhile, when the door 32*b*(or 32*a*) is to be opened, a handle(not shown) attached to an external surface of the door 32*a*(or 32*b*) is, pulled, whereupon the metal plate 47*b*(or 47*a*) disposed on an inner side of the slide member 70*b*(or 70*a*) is separated from the permanent magnet 57, and at the same time, the protrusion 71*b*(or 71*a*) protrudingly formed on the inner side of the slide member 70*b*(or 70*a*) is thereby pulled out of the groove 55*b*(or 55*a*) formed on the body 100.

At this time, the curved surface 72*b*(or 72*a*) formed internally on the slide member 70*a*(or 70*b*) is moved outwardly along the guide surface 53*b*(or 53*a*) formed on the body 100, and at the same time, the guide rails 75*b* and 75*a* integrally formed on the curved surface 72*b*(or 72*a*) travel along the guide groove 79*b*(or 79*a*) formed on the body 100 to thereby release the locked status and open the door 32*a*(or 32*b*) as illustrated in FIG. 4.

When the doors 32*a* and 32*b* are opened, the roller 88*b*(or 88*a*) of the holding means 81*b*(or 81*a*) engaged with the keeper groove 77*b*(or 77*a*) disposed on the vertical surface 73*b*(or 73*a*) of the slide member 70*b*(or 70*a*) is pushed toward the elastic means 86*b*(or 86*a*) by pressure from the keeper groove 77*b*(or 77*a*) as the protrusion 71*b*(or 71*a*) is released from engagement of the groove 55*b*(or 55*a*) in the body 100, to thereby make it easy for the door 32*b*(or 32*a*) to be opened.

From the foregoing, although the opening and closing of the left door 32*a* in the refrigerator has been described by way of example, the same is applied to the case where the left and right doors 32*a* and 32*b* are simultaneously opened and closed, thereby deleting redundancy of the explanation.

As seen from the aforesaid, according to the first and second embodiments of the present invention with respect to a door holding apparatus of a refrigerator, the interior of the refrigerator is kept airtight by way of operation of the holding means during door closure, and at the same time, the airtightness is improved to thereby increase freezing efficiency and reduce the electric power consumption as well.

Having described specific embodiments of the invention with reference to the accompanying drawings, it is to be understood that the invention is not limited to those embodiments, and that various changes and modifications may be effected therein by one skilled in the art without departing from the scope or spirit of the invention as defined in the appended claims.

What is claimed is:

1. A refrigerator comprising a body forming a refrigeration compartment having an opening; a pair of side-by-side swinging doors for closing said opening, each door comprising a frame having a vertical first edge hinged to said body, and a vertical second edge arranged to face said second edge of the other door when said doors are closed; a slide mounted to each of said second edges for horizontal movement inwardly toward and outwardly from its respective first edge; biasing means for biasing said slides inwardly; and slide-displacing means on said body for sliding each slide outwardly in response to closing of its respective door; each slide including a projection arranged to extend toward said body when the respective door is in a closed state, said body including grooves for receiving respective ones of said projections.

2. A refrigerator according to claim 1, wherein said slide-displacing means comprises guide surfaces disposed on said body and arranged to contact respective slides.

3. A refrigerator according to claim 2, wherein each guide surface is convexly curved.

4. A refrigerator according to claim 1, wherein each frame forms a chamber in which a respective slide is disposed.

5. A refrigerator according to claim 1, wherein said biasing means comprises tension springs disposed in respective ones of said chambers.

6. A refrigerator according to claim 1, wherein said slides include respective free outer edges which face one another when said doors are closed, resilient packing members mounted on respective ones of said free outer edges for engaging one another to form an air seal when said doors are closed.

7. A refrigerator according to claim 6, wherein one of said body and slides carries permanent magnet means, the other of said body and slides carrying metal plates arranged to contact said permanent magnet means when said doors are closed.

8. A refrigerator according to claim 7, wherein a magnetic force attracting each metal plate is strong enough to resist an inward biasing force applied to each slide by its respective biasing means.

9. A refrigerator according to claim 1, wherein each frame includes a stop surface limiting the extent to which its respective slide can travel outwardly.

10. A refrigerator comprising a body forming a refrigeration compartment having an opening; a pair of side-by-side swinging doors for closing said opening, each door comprising a frame having a vertical first edge hinged to said body, and a vertical second edge arranged to face said second edge of the other door when said doors are closed; a slide mounted to each of said second edges for horizontal movement inwardly toward and outwardly from its respective first edge; each slide extending vertically beyond upper and lower edges of said opening; said slides being biased inwardly toward said first edge of its respective frame; slide displacing means on said body for sliding each slide outwardly in response to closing of its respective door; each slide carrying a projection arranged to enter a respective groove in said body when said doors are closed; and holding means disposed on said body and engageable with a keeper groove formed on each side.

11. A refrigerator according to claim 10, wherein said holding means comprises clamp members movably mounted on said body, and yieldable biasing means biasing each clamp member in a direction for entering a keeper groove when its respective door is closed.

12. A refrigerator according to claim 10, wherein said frame of each door includes a chamber in which a respective slide is slidably disposed, and spring means biasing each slide inwardly.

13. A refrigerator according to claim 10 including stop means on each frame for limiting the extent of outward sliding of its respective slide.

14. A refrigerator according to claim 10, wherein said displacing means comprises guide surfaces on said body, each guide surface extending into a respective one of said grooves for guiding a respective one of said projections into said groove during closing of said door.

15. A refrigerator according to claim 10, wherein said slides includes respective free outer edges which face one another when said doors are closed, resilient packing members mounted on respective ones of said free outer edges for engaging one another to form an air seal when said doors are closed.

16. A refrigerator according to claim 10, wherein one of said body and slides carrying permanent magnet means, the other of said body and slides carrying metal plates arranged to contact said permanent magnet means when said doors are closed.

17. A refrigerator according to claim 16 including biasing means biasing said slides inwardly with a biasing force, a magnetic force applied to each slide by said permanent magnet means being strong enough to resist said biasing force.

18. A refrigerator comprising a body forming a refrigeration compartment having an opening; a pair of side-by-side swinging doors for closing said opening, each door comprising a frame having a vertical first edge hinged to said body, and a vertical second edge arranged to face said second edge of the other door when said doors are closed; a slide mounted to each of said second edges for horizontal movement inwardly toward and outwardly from its respective first edge; biasing means for biasing said slides inwardly; and slide-displacing means for sliding each slide outwardly in response to closing of its respective door; wherein one of said body and slides carries permanent magnet means, the other of said body and slides carrying metal plates arranged to contact said permanent magnet means when said doors are closed.

19. A refrigerator according to claim 18, wherein said body carries said permanent magnet means, said slides carrying said metal plates.

20. A refrigerator comprising a body forming a refrigeration compartment having an opening; a pair of side-by-side swinging doors for closing said opening, each door comprising a frame having a vertical first edge hinged to said body, and a vertical second edge arranged to face said second edge of the other door when said doors are closed; a slide mounted to each of said second edges for horizontal movement inwardly toward and outwardly from its respective first edge; biasing means for biasing said slides inwardly; and slide-displacing means for sliding each slide outwardly in response to closing of its respective door; wherein said slide-displacing means comprise guide surfaces disposed on said body and arranged to contact respective slides.

21. A refrigerator comprising a body forming a refrigeration compartment having an opening; a pair of side-by-side swinging doors for closing said opening, each door comprising a frame having a vertical first edge hinged to said body, and a vertical second edge arranged to face said second edge of the other door when said doors are closed; a slide mounted to each of said second edges for horizontal movement inwardly toward and outwardly from its respective first edge; biasing means for biasing said slides inwardly; and slide-displacing means for sliding each slide outwardly in response to closing of its respective door; wherein each frame includes a stop surface limiting the extent to which its respective slide can travel outwardly.

* * * * *